United States Patent [19]

Rewitzer

[11] Patent Number: 5,074,101

[45] Date of Patent: Dec. 24, 1991

[54] PROCESS AND APPARATUS FOR PACKAGING AND PRESSING LOOSE FIBER

[75] Inventor: Siegfried Rewitzer, Kelheim, Fed. Rep. of Germany

[73] Assignee: Hoechst Aktiengesellschaft, Fed. Rep. of Germany

[21] Appl. No.: 496,631

[22] Filed: Mar. 21, 1990

[30] Foreign Application Priority Data

Mar. 23, 1989 [DE] Fed. Rep. of Germany ..... 3909566

[51] Int. Cl.[5] ..... B65B 1/24; B65B 63/02

[52] U.S. Cl. ..... 53/436; 53/475; 53/54; 53/527; 100/215; 141/73; 141/256

[58] Field of Search ..... 53/54, 436, 438, 475, 53/502, 523, 526, 527, 528, 529; 100/215, 240, 246; 141/71, 73, 256

[56] References Cited

U.S. PATENT DOCUMENTS

| | | | |
|---|---|---|---|
| 3,404,742 | 10/1968 | Bonneric | 141/71 X |
| 3,481,268 | 12/1969 | Price | 53/529 X |
| 3,563,168 | 2/1971 | Doninger | 53/529 X |
| 3,721,060 | 3/1973 | Quinto | 53/527 |
| 4,054,018 | 10/1977 | Neukom | 53/527 X |
| 4,055,203 | 10/1977 | Crawford et al. | 141/73 |
| 4,162,603 | 7/1979 | Stromberg | 53/529 X |
| 4,280,538 | 7/1981 | Hazelbaker | 141/316 X |
| 4,372,101 | 2/1983 | Fleissner | 53/527 X |
| 4,526,095 | 7/1985 | Rewitzer | 53/527 X |
| 4,572,065 | 2/1986 | Fishburne | 53/527 X |
| 4,813,205 | 3/1989 | Mikata et al. | 53/167 X |

FOREIGN PATENT DOCUMENTS

| | | | |
|---|---|---|---|
| 0014923 | 8/1980 | European Pat. Off. . | |
| 0029977 | 11/1980 | European Pat. Off. . | |
| 0115069 | 12/1980 | European Pat. Off. . | |
| 3009016 | 9/1981 | Fed. Rep. of Germany | 53/527 |
| 3335754 | 4/1985 | Fed. Rep. of Germany | 53/436 |

*Primary Examiner*—John Sipos

*Attorney, Agent, or Firm*—Connolly & Hutz

[57] ABSTRACT

Apparatus and process for the packaging and pressing in bale form of loose fiber material comprising short-length fibers or fibers of high slipperiness, using a fill shaft (2) in which a distributing means (6) ensures that the fiber is transferred uniformly to a clearer means (7) which already has the width (4) of the press container opening (5), the clearer means (7) transports the fiber together with a longitudinal homogenizer means (9) in such a way as to ensure uniform filling of the press container (11), and the fiber so introduced can then be pre-pressed, end-pressed, packed in bale form and reinforced in a conventional manner.

18 Claims, 6 Drawing Sheets

1
6
19
17
2
17
9
3
12
7
21
21
24
24
20
23
22
5
20
14
14
11
41
4
41
15
41
13
13
16
43
44
44

1
2
3
4
5
6
7
8
9
11
12
13
14
15
16
18
19
20
21
22
23
24
41
43
44

PROCESS AND APPARATUS FOR PACKAGING AND PRESSING LOOSE FIBER

The present invention relates to a process for the depositing, packaging and pressing in bale form of loose fiber material comprising short-length fibers or other fibers of high slipperiness, and suitable apparatus therefor.

It is generally known to deposit loose staple fiber material in containers, to pre-press more than once and then to carry out a final pressing in a second press. The material thus pressed is customarily packed in sheetlike packaging material, for example plastics sheeting, and provided in the highly pressed state with a reinforcement. The bales thus produced are the customary form for shipping staple-fiber material. Of proven utility are carousel presses where two press boxes are arranged rotatable about a vertical axis, these boxes being each filled in the pre-pressing stage with fiber material which is pre-pressed from time to time and then, after the pair of press boxes has been rotated by 180°, subjected to the action of the main press ram. Such presses are described for example in detail in DE-A-2 523 043 and also in DE-B-2 042 004.

In later embodiments, the rigid coupling between pre-press and main press system has been broken in that the press boxes used are no longer associated with a specific press but are freely movable and can be stored before transporting in any desired order into a pre-press or the main press. It is already known from DE-A-2 736 316, which is concerned with the packaging and pressing of filament tows, to make pre-pressing and final pressing independent of each other and to use press boxes which can be transported in any desired manner along any desired paths. The teaching is further developed in EP-Bl-0 014 923, where the final pressing can be carried out in the transportable press containers. According to said patent specification, the final packaging and reinforcement of the bales takes place in the final press. If higher utilization of this process is required, EP-Bl-0 029 977 teaches that the packaging operations can also take place outside the actual main press.

Particular advantages resulting from the use of freely movable press containers, for example the possibility of accurately weighing the contents of a press container, are described for example in EP-Bl-115 069.

It is a prerequisite for all these packaging processes that the staple fibers to be packaged have a certain cohesion and thus make it possible for example to meter or deposit the loose fiber into the pre-press but also ensure the stability of the bale before the final packaging and reinforcement. These prerequisites no longer pertain with a number of short-length fibers, i.e. fibers not more than about 20 mm, preferably from 4 to 12 mm, in length. Such materials, which are used for example as reinforcing fibers in inorganic matrices, in addition usually have only a very small degree of crimp, if any. But even if the material has a crimp, undesirable slippages may occur, as for example in the depositing, pressing and packaging of siliconized staple fibers as used for example as filling fibers for cushions, bedding and strongly thermoinsulating clothing. In all these cases the friction between the fibers is much reduced, causing great problems with the uniform filling of the pre-press systems, with the transport of the material thus accumulated and with the packaging after the final pressing.

It is an object of the present invention to find a depositing, bale pressing and packaging system for these staple fibers of particularly high slipperiness which can ideally be integrated in existing packing and pressing systems.

It has now been found that the use of box bags of the type hitherto only used for the packaging of filament tows is a suitable way of ensuring the stability of the pre-pressed or end-pressed material, provided care is taken to ensure that there are very few inhomogeneities and mass differences within the charge of loose fiber material which has been introduced.

Whereas in the processing of staple fibers for customary textile purposes it is perfectly sufficient to allow the material to fall freely into the press container, the packaging of uncrimped short-length fibers, for example 6 mm in length, for example, requires meticulous care to ensure that the material which is introduced is distributed very uniformly over the entire cross-section of the press box. If this uniformity is not achieved, there is a danger that slipping may occur in the transport or in the packaging of this material in bale form and lead to the displacement of contents within the bale or even to the complete disintegration of this form of package. In addition, there is in particular a danger that nonuniform setting of the material would prevent uniform application of the force of the press ram. This means that there is a danger that the press ram will become stuck. It was necessary therefore to develop additional techniques and devices which are free of the abovementioned disadvantages.

Trials confirm that adequate homogenization is no longer achievable by stirring or the like within the press container. On the contrary, it was found that it is necessary to effect separate homogenization of the fiber in the direction of the width of the press box and in the direction of the length of the press box.

The solutions found form the subject-matter of the main process claim and the main apparatus claim, while specific embodiments which are preferred form the subject-matter of subclaims.

The present invention will now be further explained for process and apparatus together with reference to the accompanying drawings, where FIG. 1 shows a schematic representation of a suitable apparatus for packaging and pressing such loose fiber material;

FIGS. 2*a* and 2*b* show a section along the plane II—II′ of the apparatus of FIG. 1, with FIG. 2*a* containing a pivoting trunk in the fill shaft while FIG. 2*b* has a movable paddle at that point;

Figure 1:
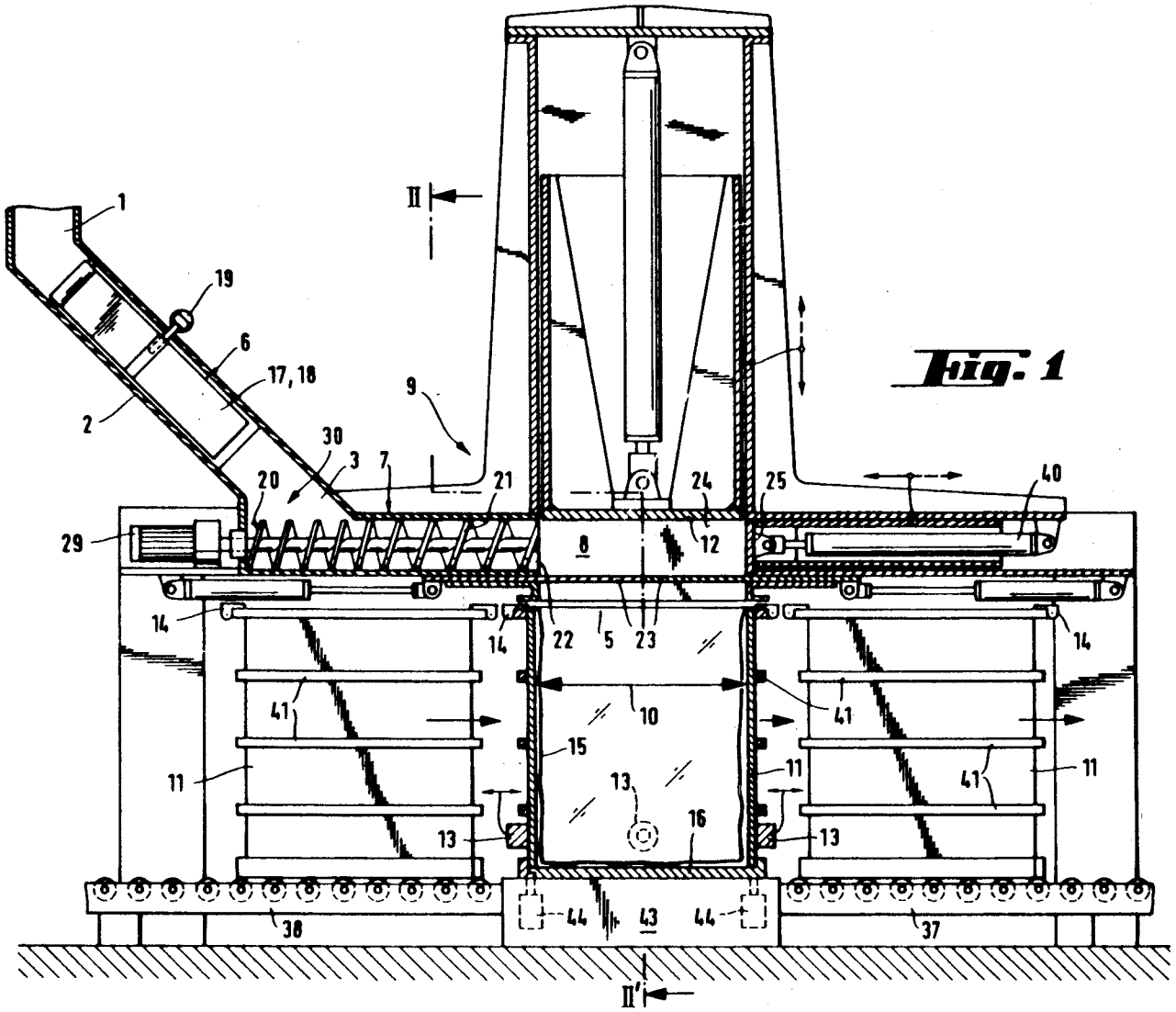

The working of the apparatus for packaging and pressing loose fiber material and the process involving its use will first be described in general terms with reference to FIGS. 1, 2*a* and 2*b*. The loose fiber material to be packaged arrives at the apparatus via a delivery pipe (1) and falls through the fill shaft (2) into the opening (30) of the clearer means. It is necessary here that the loose fiber material be properly distributed. As is evident from FIGS. 2*a* and 2*b*, the fill shaft already has, at least at its lower end (3), a width which substantially corresponds to the width of the press container (11) into which the material is packaged and pressed. To obtain uniform charging of the clearer means (7) with the loose fiber material, it is necessary to use a pivotable distributing means (6). This pivotable distributing means can take the form for example of a pivotable trunk (17) which is moved forward and backward in the fill shaft (2) by means of an actuating means (19). The same distributing function can also be achieved by means of a pivotably mounted paddle (18) which is likewise connected to a drive means (19). These means make it possible to fill the space above the discharge opening (3) from the fill shaft (2) with loose fiber material uniformly across the entire width (4). The fiber then transfers to a clearer means (7). This clearer means can consist for example of an endless conveyor belt with attached knobs or hooks or of a vibratory conveyor of appropriate width (4). What is important is that this clearer means is capable of transporting the load of fiber produced by the pivotable distributing means (6) without producing any noticeable change in the fiber pack density measured across the width of the clearer means. The Figures show the clearer means (7) as an arrangement of a plurality of screw conveyors (20) where the pitch of the screw helices (21), which are actuated via a drive (29), may increase in the direction of the discharge opening (22). The use of screw conveyors is preferable if the staple length is below 20 mm, while knobbed belts can be advantageous in particular with a staple length of above 20 mm and in the case of crimped fibers. Vibratory or oscillatory conveyors are notable for particularly gentle transport through the avoidance of clumping or the like.

Using this clearer means (7) or the plurality of screw conveyors (20) in a parallel arrangement it is possible to obtain uniform distribution of the fiber across the length (10) of the opening (5) of the press container (11) as long as either the discharge opening (22) of the screw conveyors (20) or clearer means (7) performs a movement relative to the opening of the press container (11) in such a way that the stroke permits a uniform distribution of fiber across the entire length (10) of the opening (5) of the press container (11), or the fiber is first collected in an equalizer space (8) before passing as an accumulation into the press container (11).

A possible embodiment for obtaining such homogenization of the fiber load density in the longitudinal direction also involves the use of an equalizer means comprising an equalizer space (8) in which the fiber delivered by the clearer means (7) accumulates. This equalizer space (8) has a bottom surface formed by the slider (23). This slider, which may have a multi-part construction, can completely seal off the equalizer space (8) from the inside of the press container (11) and, in the open state, provide a complete connection between these two spaces without preventing in any way the transport of fiber into the press container. The two longitudinal walls (24) of the equalizer space (8) are preferably flush with the inner surfaces of the press container (11) underneath. In the upward direction the equalizer space (8) is sealed off by the press ram (12). This leaves the two side walls: one side wall forms the discharge opening (22) from the clearer means (7); opposite to it is a press ram which can be advanced across the entire length (10) up to the discharge opening (22) and against which the fiber is then delivered. The counterpressure ram (25) can oppose its movement against the conveying direction of the discharge means (7) with a predetermined resistance, effected for example by a piston-cylinder unit (40) under compressed air control. Owing to the force required, a combination of vibratory conveyor and counterpressure ram (25) is not possible without special measures.

The working of this longitudinal homogenizer means (9) thus consists in distributing the fiber widthways by means (6) and over the length (10) through the filling of the equalizer space. When the counterpressure ram (25) has reached its final position, the clearer means (7) is stopped, the counterpressure ram (25) is held in its final position and the slider (23) is fully opened. The material accumulated in the equalizer space (8) is then moved into the press container (11) by lowering the press ram (12). After the press ram (12) has been lifted up into its upper rest position, the slider (23) closed and the counterpressure ram (25) advanced up against the discharge opening (22) from the clearer means (7), the clearer means (7) can resume operations and gradually refill the equalizer space (8) against the resistance of the counterpressure ram (25).

Figure 2A:
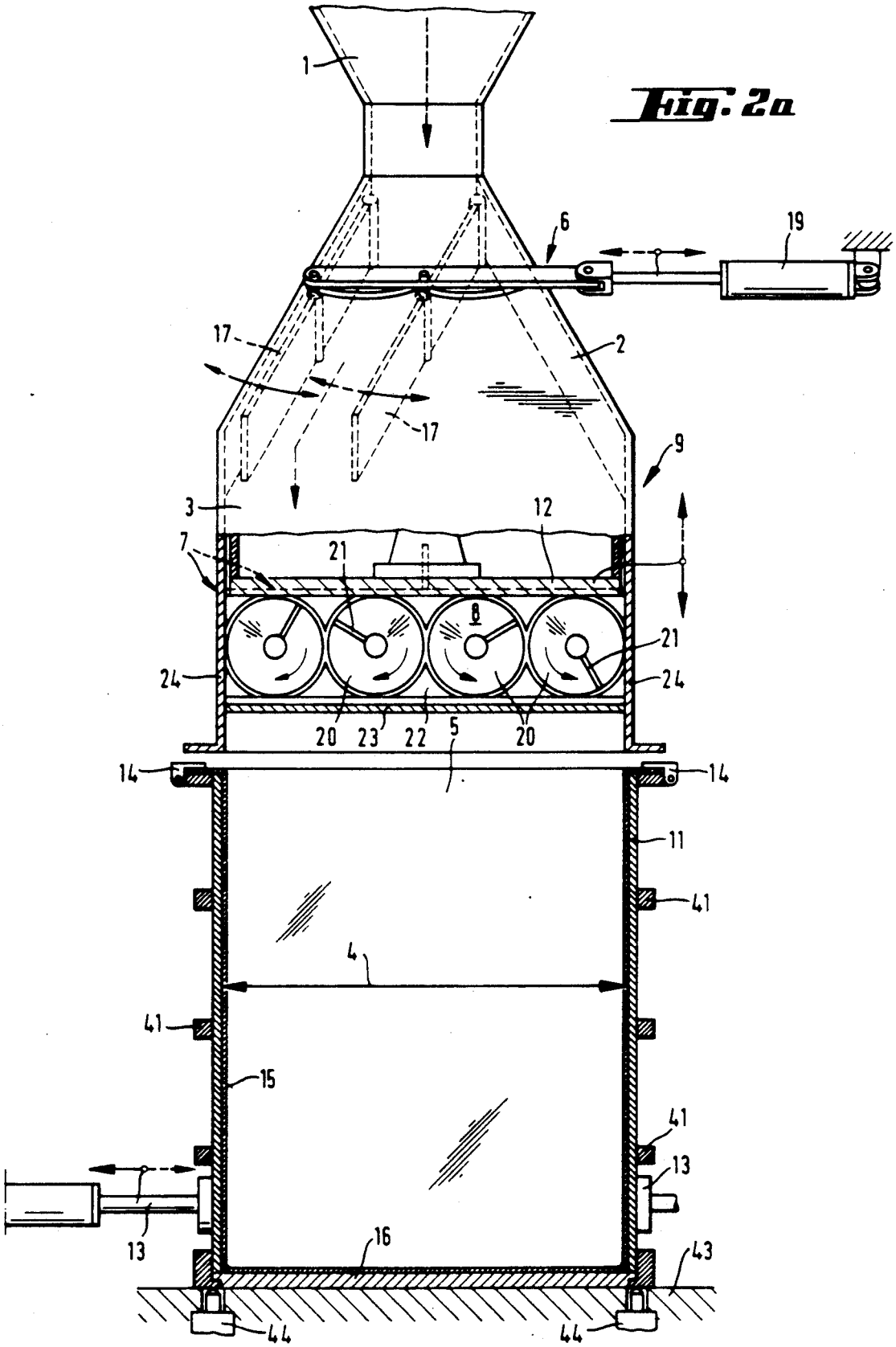
Figure 2B:
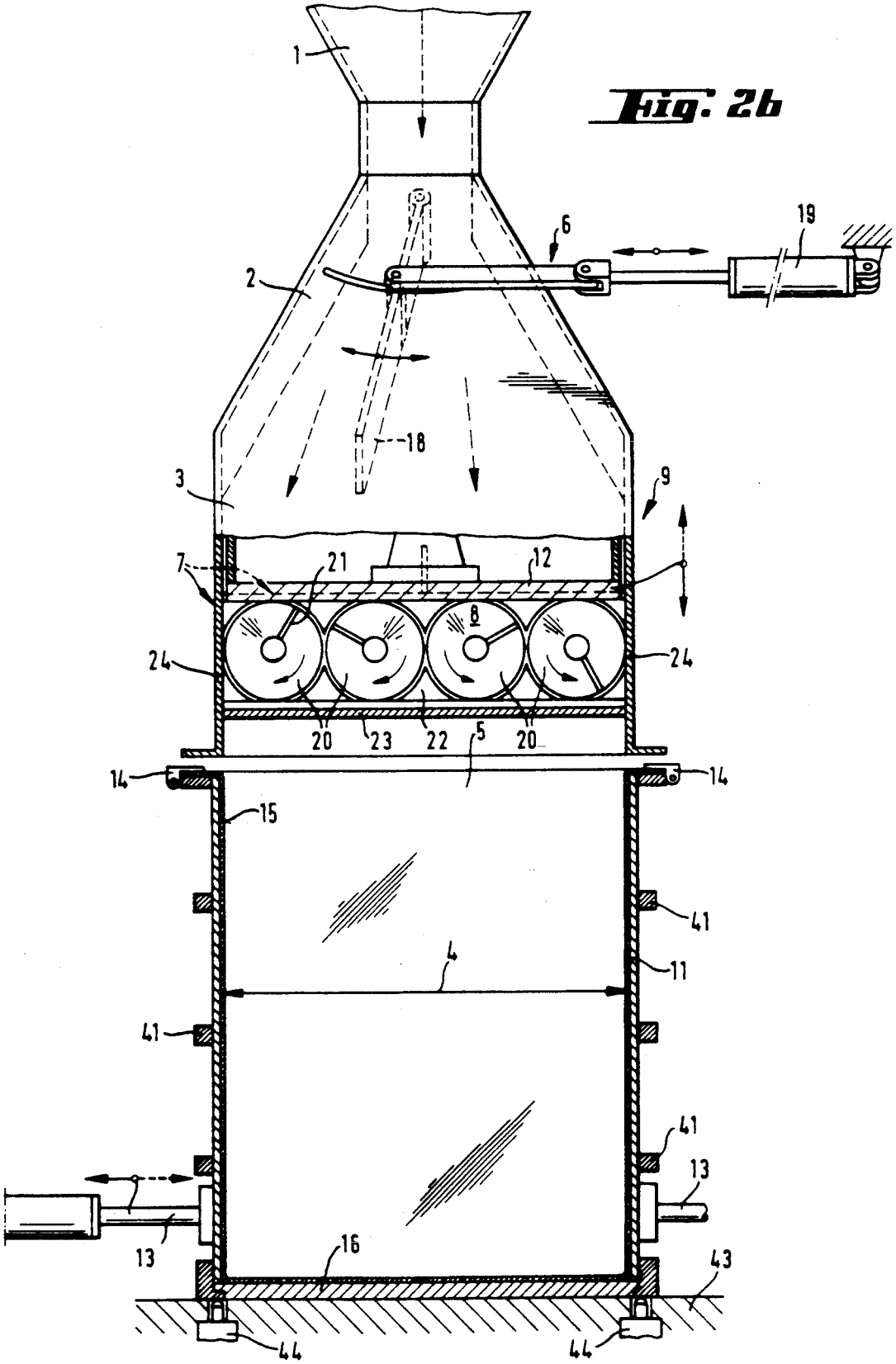

FIGS. 1, 2*a* and 2*b* also reveal the basic construction of the press container. This press container (11) should have a rectangular cross-section and should preferably not contain any internal fitments, such as retention means or tie slots or the like. It is a rectangular hollow body having the inner width (4) and length (10), which is sealed at its bottom end by a detachable base plate (16). This base plate can be retained in the simplest case like a drawer in the bottom part of the press container (11); further solutions for such a base plate are already known in the prior art. For the present packaging function it is necessary that the inside of the press container be laid out with packaging material (15), preferably with a prefabricated box bag which is held at the upper edge of the press box by clamping means (14). The packaging material for this specific loose fiber of high slipperiness can be either a box bag of sufficient size as to be still sealable by overlap after having been filled with the fiber material and compacted by the press ram (12) but before the last, ultimate pressing, for example with the press ram (12), or else another form of packaging (15) using a box bag which has approximately only the size of the side walls and the base plate of the press container (11) and subsequently receives for example an overlapping cover sheet for covering the end face before the final pressing operation.

The press container (11) should in any case constructed in such a way that it is able to withstand the pressure acting on it during pressing. To this end it has reinforcements (41) indicated on its outer surface. It is also possible to make the container (11) in a lightweight construction if the walls of the press container (11) can be given a sheetlike support during pressing or if the press box (11) can be removed from the material to be pressed at least before the final pressing.

The press containers (11) are preferably freely movable; that is, they are preferably not connected via guides or bars to the depositing or pressing means. On the contrary, they should be freely transportable by suitable transport means, for example floor conveyors or roller belts or the like. A possibility is in particular the transport to a separate final press (34) which operates independently of the fiber packaging and pressing apparatus described here. However, the final pressing can also be carried out in the apparatus of FIG. 1, possibly even in a simplified embodiment. In this case, the press box (11) should be removable from the pressed contents after detachment of the detachable base plate (16), so that unimpaired packaging of the compressed fiber material in bale form becomes possible.

As mentioned above, the press containers (11) preferably do not even have the otherwise customary retention flaps. Owing to the particular properties of the high-slip and usually low-crimp fiber material to be packaged here, the pre-pressed material does not tend to overflow out of the press container once the press ram has been withdrawn. On the other hand, retention flaps of the type known from the prior art for the packaging of normal loose fiber material have usually been ineffective owing to the high slipperiness of the fibers and their retaining effect is usually so limited as to render it dispensable.

The actual packaging and pressing of the fibrous material is carried out by the prior art process by introducing a certain amount of fiber material into the press container and then lowering the press ram (12) in order to precompact this material; thereafter the press ram goes back up for reuse following the introduction of a further load of fiber material. It is possible in this way to obtain adequate pre-compression of the material, in particular if it has been made possible, by the mans used, to obtain a very uniform filling of the press container with the loose fiber.

Figure 3:
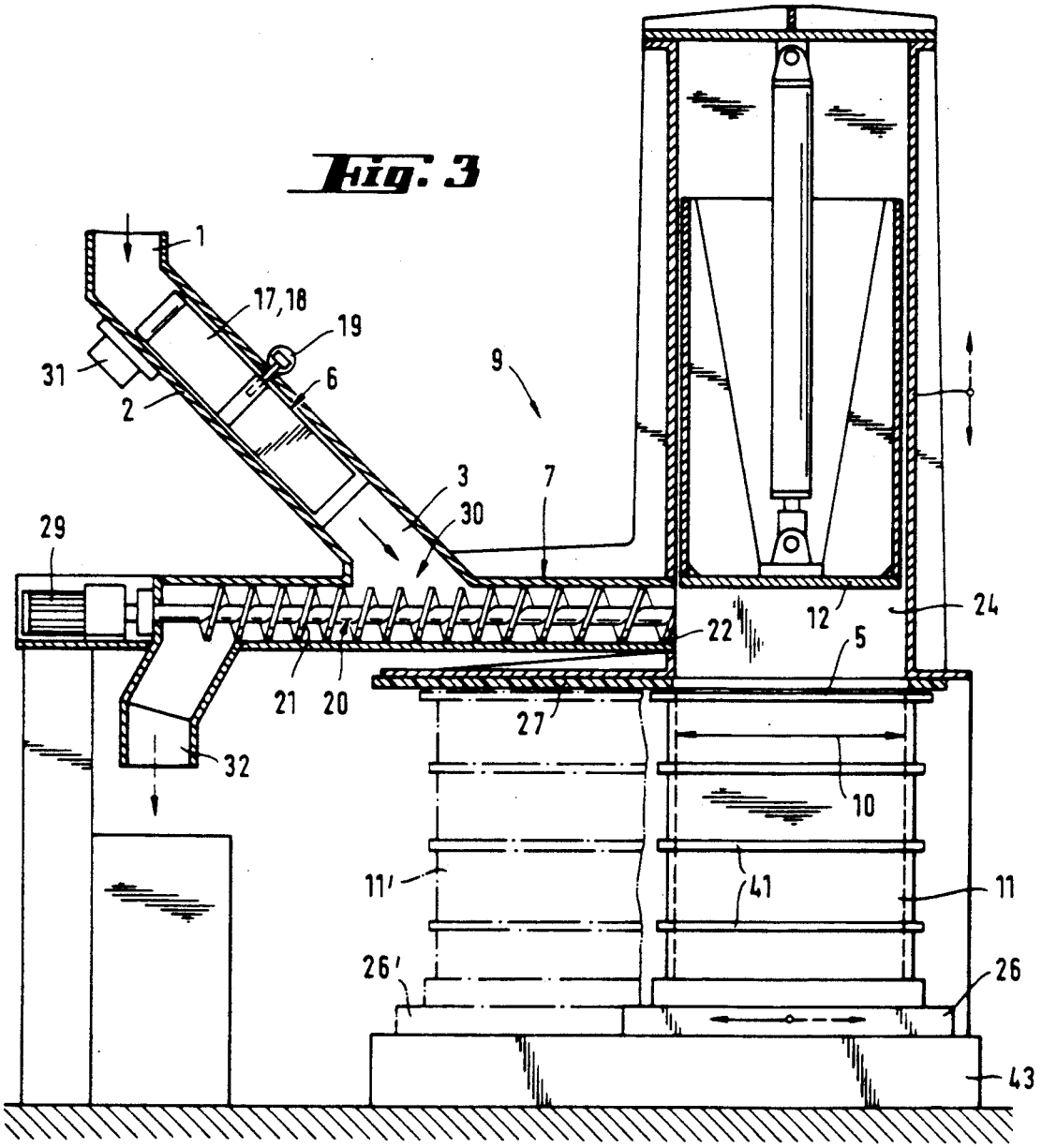
FIG. 3 shows a further embodiment of the apparatus, where the press box is moved forward and backward.

A further embodiment is diagrammatically depicted in FIG. 3. The fiber is distributed across the width of the press container (11) in the same way as described above, but the mechanism used for distributing the fiber in the longitudinal direction (10) of the press container is different. Here uniform distribution in the longitudinal direction is achieved by movement of the press box (11) or of its opening (5) relative to the discharge opening (22) from the clearer means (7) which in FIG. 3 is again shown as an aggregation of a plurality of screw conveyors. The relative movement between the clearer means, or the discharge opening from the clearer means, and the press container (11) is effected by using a traverse means (26) which leads to a forward and backward movement of the press box (11). FIG. 3 shows the one end position of this traverse movement, in which also the intermediate and, as the case may be, the final pressing of the fiber material takes place with the press ram (12), in solid lines and the other end position of the press box (11') together with the traverse means (26') in a dash-dot line. To avoid any fiber fly is possible it is necessary to ensure that the press box stays properly sealed during the traverse movement as well; such a seal (27) has likewise been indicated in FIG. 3. The fill shaft (2) also contains at least one foreign body sensor (31) or the like, which is coupled to the drive for the clearer means (7) in such a way that a response by this detector reverses the conveying direction of the clearer means (7) for a certain short time period and fiber material can then be automatically eliminated together with the foreign body via the outlet (32). Such foreign bodies are for example blade fragments which are very readily detectable by appropriate metal detectors.

Figure 4:
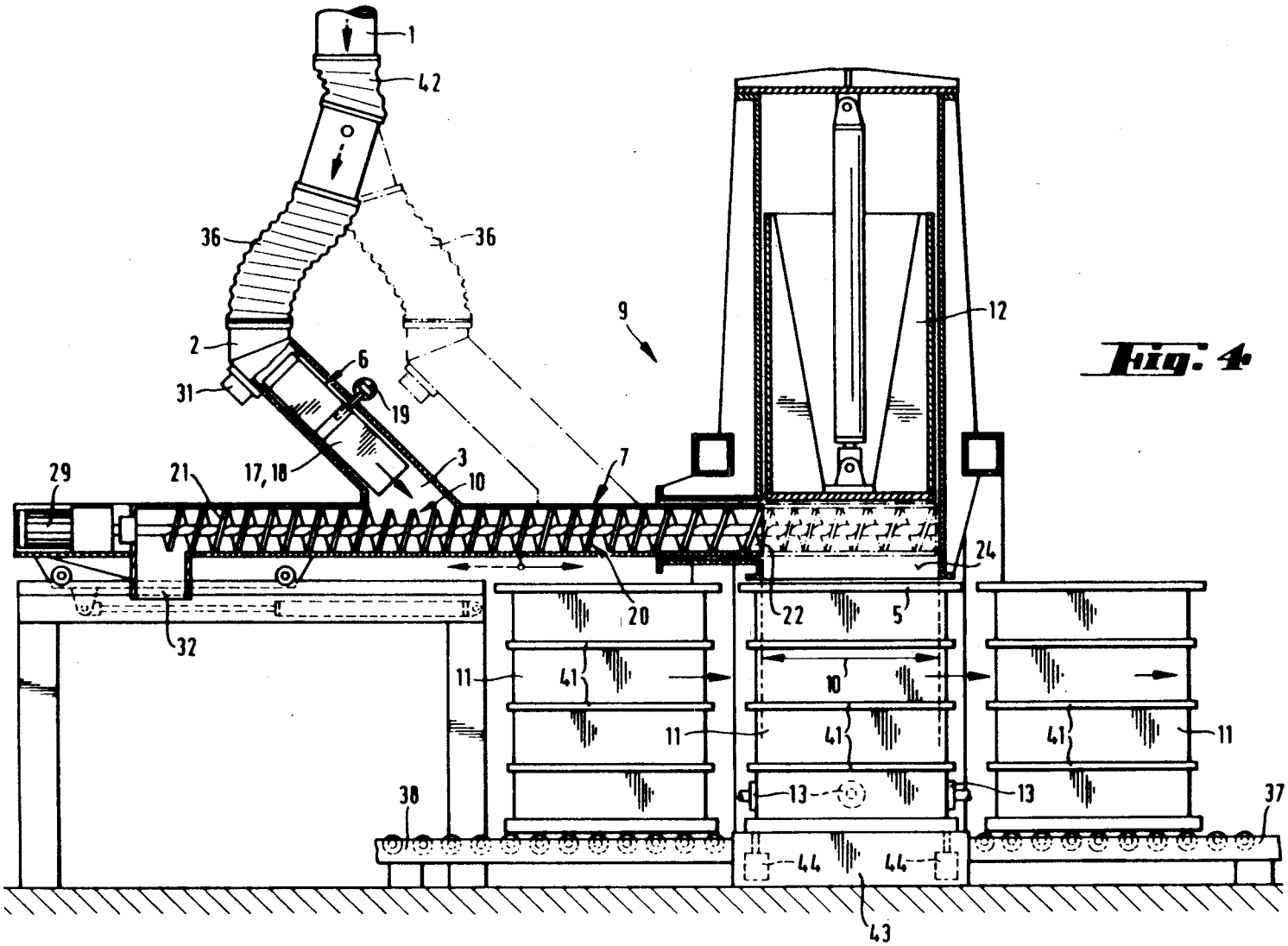
FIG. 4 shows a further embodiment of the apparatus, where the clearer means is moved forward and backward.

FIG. 4 shows a further embodiment of the apparatus of the present invention. In this case the fiber is distributed in the longitudinal direction (10) of the press box (11) by a traverse movement of the entire clearer means (7) while the press container (11) is fixed in the filling and pressing position. Further press containers (11) besides the actual press container in the pressing position are intended to indicate the delivery and removal of such press containers. Of these, the left-hand press container will still be in the empty state, equipped only with a box bag, while the right-hand container (11) contains already-pressed material which is to be transported to a final press. The possible transport means indicated here are roller or roll conveyors (37, 38).

As mentioned above, the clearer means of this embodiment moves forward and backward. This movement is produced by a traverse means which moves the clearer means (7), including the drive (29), forward and backward. Here too the stroke of this traverse means should be such that, in a left-hand end position, the opening of the press container (11) is completely open, so that the press ram (12) can be lowered, and on the other side the stroke should be sufficient to ensure uniform sprinkling of the loose fiber material over the entire length of the press container. In this case too a possible alternative to clearer means (7) is a vibratory or oscillatory conveyor of appropriate width.

In a particularly preferred embodiment, the discharge opening (3) from the filling shaft (2) which is connected to the inlet opening (30) to the clearer means (7) forms part of this traverse means. To this end it is necessary to connect the fill shaft (2) and the delivery pipe (1) for loose fiber material together using at least one elastic connecting member (36) with or without (42). These elastic members are made for example from an elastic plastic or rubber and have approximately the shape of the fill shaft. The two end positions of the traverse movement of the clearer means (7) are likewise indicated in FIG. 4. The solid lines represent the end position in which the use of the presser ram (12) is possible without damaging the clearer means. The dash-dot lines show the other end position which is necessary for discharging the loose fiber material as far as the other side of the press container. This apparatus too is equipped with foreign body sensors (31) and a reversing mechanism for the drive (29), so that foreign bodies can be expelled via the outlet (32).

FIG. 4 shows a base (43) which likewise possesses transport means for the press container (11) but also appropriate positioning means (13). In addition, it may possess force transducers (weighing cells) which are fixed for example to pneumatic adjusting elements (not shown) and which make it possible to monitor the fill level, i.e. the amount of fiber which has been introduced, continuously. Advantageously, these force transducers (44) are moved away or down again before any actuation of the press ram (12) in order that damage may be avoided if possible during the actual pressing operation. If a plurality of weighing cells are used, it may even be possible to monitor the uniformity of the distribution of the loose fiber material and if necessary to influence the effectiveness of the distributing means (6) and/or (9).

The working of this apparatus is similar to that described above in the case of the apparatus of FIG. 1. Loose fiber falls through the fill shaft (2) and the elastic members (36) with or without (42) into the clearer means after it has been uniformly distributed by pivotable distributing means (6) across the width of the fill shaft. The lower discharge opening from the fill shaft and the clearer means already have an operating width which corresponds to the width (4) of the press container (11). During operation, the clearer means moves forward and backward between two limiting points.

Figure 6:
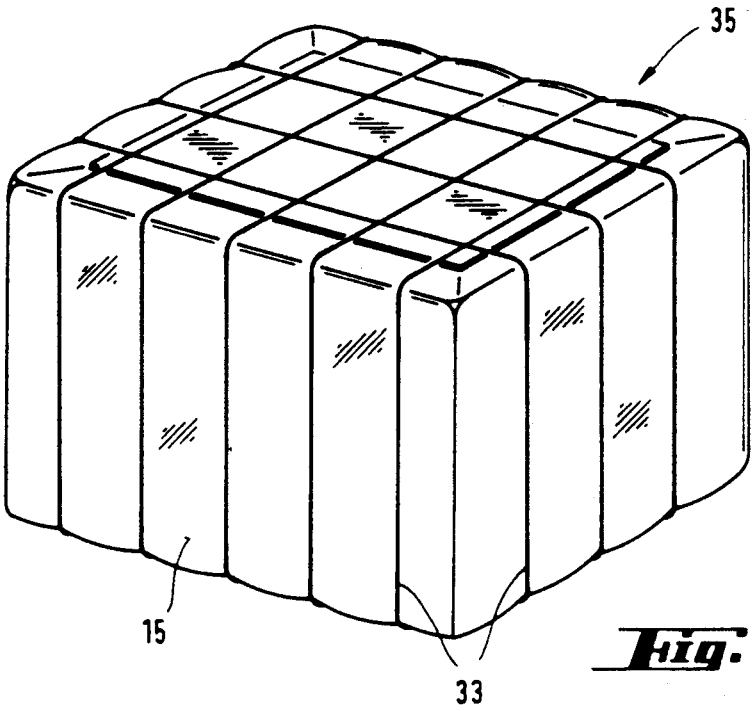
FIG. 6 shows an actual product in the form of a bale.

One of the limiting positions permits the safe lowering of the press ram (12) into the press container (11), while the other end position satisfies the requirement for a uniform distribution of the fiber across the entire length of the press container (11). The press containers (11) are lined with packaging material in box-bag form before being filled. These box bags are held by appropriate clamping means (14). The intermittent pressing by the press ram (12) ensures compaction of the fiber material. After completion and sealing of the package the fibrous contents can be given a final pressing in the press container (11). It is then possible, by suitable means, to remove the press container (11) from the pressed contents after removal of the detachable base plate (16) and to fix the fiber pack in the highly compressed state in bale form (35), for example by applying reinforcements in the form of tape steel or wires (33) (FIG. 6). It is also possible to remove the press container (11) before the final pressing.

Such a final pressing and packaging of the material need not be carried out by means of the press ram (12) of the apparatus, but can also be carried out in a possibly separate final press (34) with or without press container (11).

Figure 5:
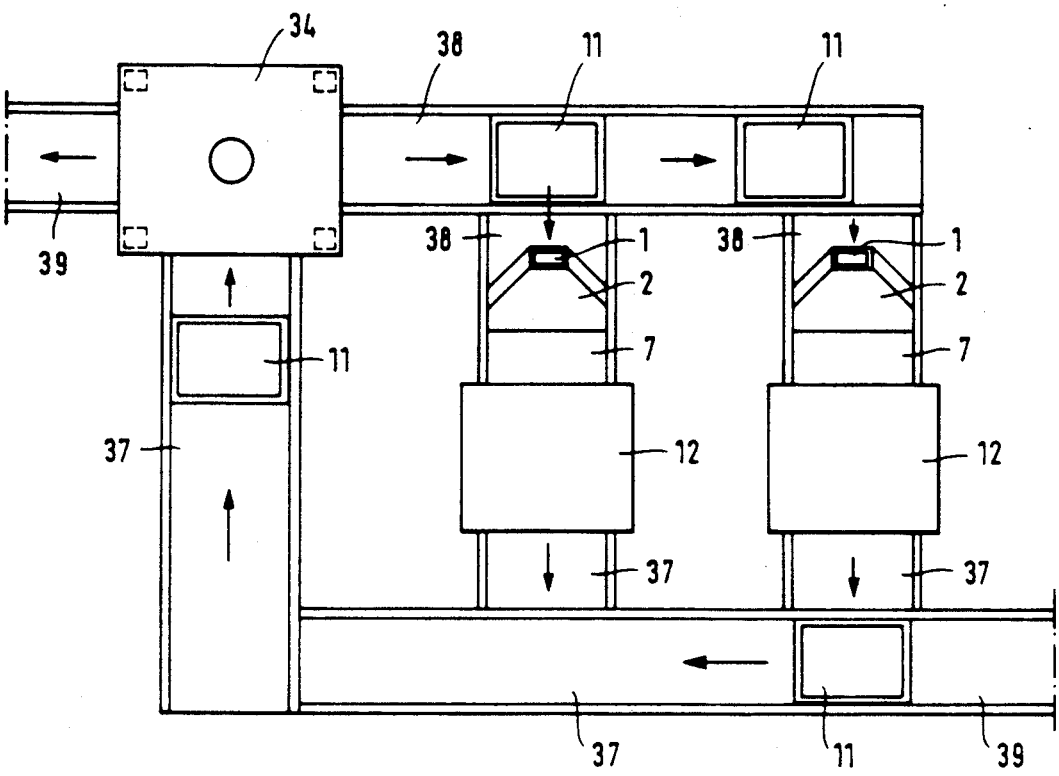
FIG. 5 shows a possible arrangement of depositing means and associated presses and an end press in a schematic representation.

The separation between a filling and pressing apparatus and the final press has been known for decades from carousel presses for the packaging of loose fiber material. Such press systems can also be used in the present case. However, it is also known to package by means of freely movable, transportable press containers. A schematic representation of a possible arrangement is reproduced in FIG. 5. Here two depositing and prepressing means are arranged side by side. The press boxes (11) arrive from the pre-pressing means via roller belts (37), at a central press (34) in which the final pressing and packaging is carried out. The empty press containers are sent back to the depositing and pre-pressing means via roller belts (38). Such a system may form part of a larger pressing plant using various pre-presses or tow depositors. These possibilities are indicated by the additional roller belts (39).

What is claimed is:

1. Apparatus for pressing and packaging in bale form loose fiber material of short-length slippery fibers or other fibers of high slipperiness comprising a fill shaft for the loose fiber to be packaged having a discharge opening with a width equal to that of a press container into which the loose fiber is deposited, pivotal distributing means inside the fill shaft for distributing the loose fiber across the width of the discharge opening, horizontally oriented clearer means downstream from the discharge opening of the fill shaft for transporting the loose fiber away from the fill shaft, the clearer means having a width equal to that of a press container into which the loose fiber is deposited and including at least two screw conveyors in parallel alignment with one another, each screw conveyor having a pitch that increases in a downstream direction away from the fill shaft, longitudinal homogenizer means downstream from the clearer means for homogenizing density of the loose fiber in a longitudinal direction, a press container positioned below the longitudinal homogenizer means for receiving longitudinally homogenized fibers therefrom, and a press ram above the press container for pressing loose fibers deposited into the press container.

2. Apparatus as in claim 1 wherein the press container is freely movable, the press container having a rectangular cross-section and a detachable bottom end.

3. Apparatus as in claim 1 wherein the pivotal distributing means inside the fill shaft includes a trunk movable from one side of the fill shaft to the other.

4. Apparatus as in claim 1 wherein the pivotal distributing means inside the fill shaft includes a single blade paddle movable from one side of the fill shaft to the other.

5. Apparatus as in claim 1 wherein the longitudinal homozenizer means includes an equalizer space above the press container and directly below the press ram for receiving loose fibers from the clearer means, the equalizer space having the same cross-section as the press container, a reciprocating slider directly below the equalizer space forming a bottom wall of the space, and means withdrawing the slider when the equalizer space is filled with loose fiber whereby the loose fiber in the equalizer space is deposited into the press container.

6. Apparatus as in claim 5 wherein he equalizer space includes an end wall opposite the clearer means, the end wall comprising a counter-pressure ram constructed and arranged to oppose movement of the loose fiber into the equalizer space with a predetermined resistance.

7. Apparatus as in claim 1 wherein the longitudinal homogenizer means includes means reciprocating the press container back and forth under the clearer means whereby loose fibers are deposited from the clearer means into the press container in a back and forth manner.

8. Apparatus as in claim 1 wherein the longitudinal homogenizer means includes reciprocating means for the clearer means above the press container whereby loose fibers are deposited from the clearer means directly into the press container in back and forth manner.

9. Apparatus as in claim 8 including a flexible conduit connecting between the discharge opening of the fill shaft and the clearer means.

10. Apparatus as in claim 1 wherein the fill shaft includes foreign body sensors, and means for removing foreign bodies when they are detected by the sensors.

11. Apparatus as in claim 1 including clamping means on the press container for attaching packaging material inside the press container.

12. A process for pressing and packaging in bale form loose fiber material of short-length slippery fibers or other fibers of high slipperiness comprising the steps of uniformly distributing loose fiber in a fill shaft having a discharge opening with a width equal to that of a press container into which loose fiber is to be deposited, conveying loose fiber away from the fill shaft with at least two screw conveyors in parallel alignment with one another, each screw having a pitch that increases in a downstream direction, the conveying being carried out while maintaining the same width of loose fiber as discharged from the fill shaft, homogenizing density of the loose fiber in a longitudinal direction, depositing homogenized loose fiber into a press container, and pressing the homogenized loose fiber in the press container.

13. A process as in claim 12 including the step of utilizing a freely movable press container.

14. A process as in claim 12 including the step of continuously weighting the press container and the loose fiber deposited therein, and terminating deposit of the loose fiber into the container when a predetermined weight is reached.

15. A process as in claim 12 wherein the step of homogenizing density of the loose fiber in a longitudinal direction includes storing the loose fiber above the press container and releasing the stored loose fiber into the press container when a sufficient quantity has been collected, and repeating such storage and release until the press container is filled.

16. A process as in claim 12 wherein the step of homogenizing density of the loose fiber in a longitudinal direction includes the step of relative reciprocation between the press container and the loose fiber conveyed away from the fill shaft whereby loose fiber is deposited into the press container in a back and forth manner.

17. A process as in claim 16 wherein the press container is stationary and the conveyed loose fiber reciprocates back and forth as it is deposited into the press container.

18. A process as in claim 12 including the steps of detecting and removing foreign bodies from the loose fiber prior to deposit in the press container.

* * * * *